United States Patent [19]

Bennett

[11] 4,064,793

[45] Dec. 27, 1977

[54] EXPANDABLE DOUBLE WALLED SMOKE STACK

[76] Inventor: Ira Michael Bennett, 307 Flora Ave., Stanhope, N.J. 07874

[21] Appl. No.: 734,337

[22] Filed: Oct. 20, 1976

Related U.S. Application Data

[63] Continuation-in-part of Ser. No. 633,012, Nov. 18, 1975, abandoned, which is a continuation-in-part of Ser. No. 607,765, Aug. 25, 1975, abandoned.

[51] Int. Cl.[2] ..... E04F 17/02

[52] U.S. Cl. ..... 98/58; 110/184; 138/114; 285/47; 285/133 R

[58] Field of Search ..... 98/58, 60; 110/184; 138/114; 126/307 R; 285/47, 133 R

[56] References Cited

U.S. PATENT DOCUMENTS

| | | | |
|---|---|---|---|
| 268,860 | 12/1882 | Browell | 126/307 R X |
| 3,368,506 | 2/1968 | Lawrence | 110/184 |
| 3,749,132 | 7/1973 | Prezewalski | 98/60 X |
| 3,752,091 | 8/1973 | Lawrence | 110/184 |
| 3,769,923 | 11/1973 | Lawrence | 110/184 |
| 3,780,639 | 12/1973 | Wood | 98/58 |

*Primary Examiner*—William E. Wayner
*Assistant Examiner*—W. E. Tapolcai, Jr.
*Attorney, Agent, or Firm*—Henry I. Steckler

[57] ABSTRACT

A double walled smoke stack is made up of stackable sections. The top part of each section has a member extending between inner and outer shells and is either downwardly prestressed towards the inner shell or is flexible. This allows the inner shell to upwardly expand.

10 Claims, 4 Drawing Figures

EXPANDABLE DOUBLE WALLED SMOKE STACK

CROSS REFERENCE

This application is a continuation-in-part of application Ser. No. 633,012, filed Nov. 18, 1975, now abandoned, which in turn is a continuation-in-part of application Ser. No. 607,765, filed Aug. 25, 1975, now abandoned. The priority of said applications is hereby claimed.

The present invention relates to smoke stacks, and more particularly to double walled ones.

BACKGROUND OF THE INVENTION

In double walled smoke stacks, which are used to reduce corrosion, an inner shell is exposed to hot flue gases, while an outer shell is not. Thus the inner shell will expand more than the outer one. Clearly, some kind of expansion means is required to prevent the inner shell from buckling or even rupturing as it expands. It is known from U.S. Pat. No. 3,368,506 to provide an expansion means in the form of a V-shaped section and a double flange at the top of the inner shell. However, such a configuration is both heavy and expensive. It is also known from U.S. Pat. No. 3,762,302 to have radially extending members to support a helically wound inner shell, but these members do not allow for expansion.

It is therefore an object of the present invention to provide a double walled expandable smoke stack that is inexpensive.

It is a further object to provide one that is light.

SUMMARY OF THE INVENTION

In brief, these and other objects are achieved by having a member extending between the inner and outer shells of each stackable section of the stack. The plate is downwardly prestressed towards the inner shell or is flexible. This allows the inner shell to expand when heated, while the outer shell remains essentially at the same length.

BRIEF DESCRIPTION OF DRAWINGS

Other objects, features, and advantages will become apparent from the description when taken in conjunction with the drawings in which.

DETAILED DESCRIPTION

Figure 1:
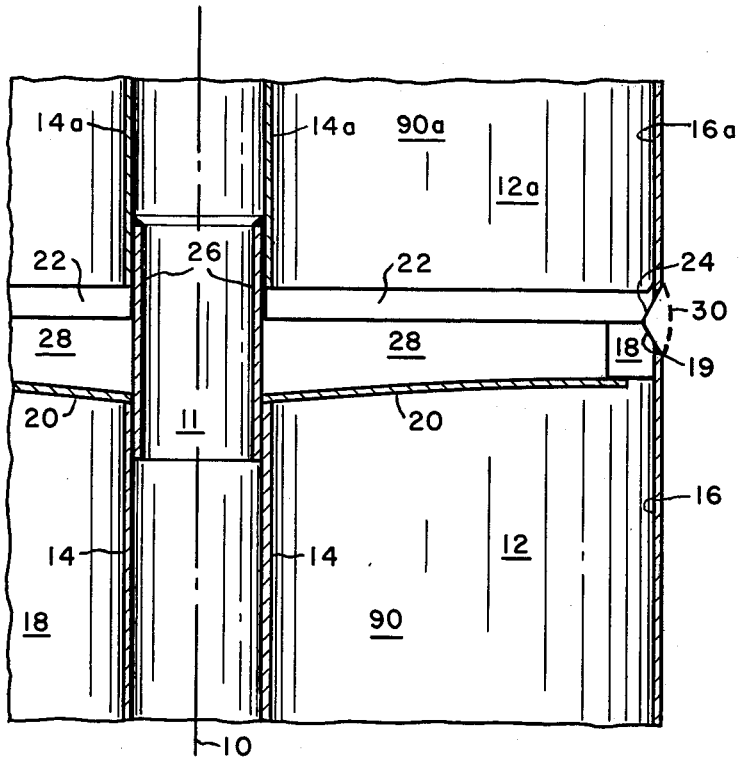
FIG. 1 is a cross-sectional view of the invention.

FIG. 1 shows a dotted line 10, which is the center line of a smoke stack flue 11. Since the invention is identically symmetrical about this line, only the right side portion is shown. Identical sections 12 and **12*a* are shown with section 12*a* stacked above section 12. In general, there will be many sections so stacked to achieve the desired overall height for the smoke stack. The top of section 12*a* is not shown since it is identical to the top of section 12 to be described below, while the bottom of section 12 is not shown since it is identical to the bottom of section 12*a***.

Section 12 comprises inner and outer circular cylindrical shells 14 and 16. Fiberglass or other insulation 90 is secured to the outer wall of inner shell 14. A circular splice ring 18 is secured to the inner wall of outer shell 16 and has a beveled edge 19. A top plate 20 is secured to the bottom side of ring 18 and downwardly extends to inner shell 14. The section **12*a*** has corresponding parts indicated by the addition of "*a*" to the numbers of section 12. It has a radially extending bottom plate flange 22 extending between inner and outer shells **14*a* and 16*a* respectively. This plate 22 transmits loads from said inner to said outer shell so that no appreciable support is required for the bottom of shell 14*a*. Plate 22 also has a beveled outer edge 24. A closure plate 26 is welded to the inner wall of shell 14*a* and is in sliding contact with the inner wall of inner shell 14. Plate 26 ensures that space 28 between sections 12 and 12*a* can contain insulating packing if desired, and that all surfaces facing flue 11 are smooth to prevent particulate buildup. The packing, if used, extends from the outer wall of shell 14, but not to the inner wall of shell 16. This allows the outer shell 16 to be placed around the inner shell 14. Due to fabrication tolerances, welding distortion, and thermal expansion, closure plate 26 will not be able to keep small particles in the flue gases from entering space 28. However, plate 20 will prevent them from contacting the inner wall of shell 16**, where they could cause great corrosion damage.

In operation, as many sections as are needed are brought to the site and stacked one above the other as shown. Then the beveled edges 19 and 24 are welded together as shown by the dotted line 30. When hot gases rise through the flue 11 they heat the inner shell 14 causing it to expand. As it does, it slides against closure plate 26 and top plate 20 becomes more horizontal, thus permitting the expansion.

Figure 2:
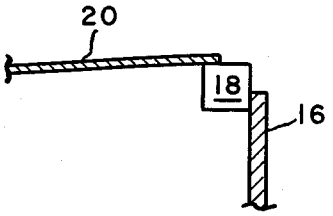
FIGS. 2, 3 and 4 are cross-sectional views of alternate embodiments.
Figure 3:
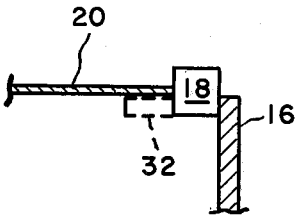

The arrangement shown in FIG. 1 for shell 16, ring 18, and top plate 20 is for maximum expansion. It may be sufficient to allow for less expansion. FIG. 2 shows an arrangement where top plate 20 is secured to the top surface of ring 18, thus allowing only a low amount of expansion. FIG. 3 shows an embodiment where top plate 20 is secured to the inner side of ring 18. An extension 32 of ring 18, shown in dotted lines, may be required for adequate structural support. This arrangement provides for an average amount of expansion.

Figure 4:
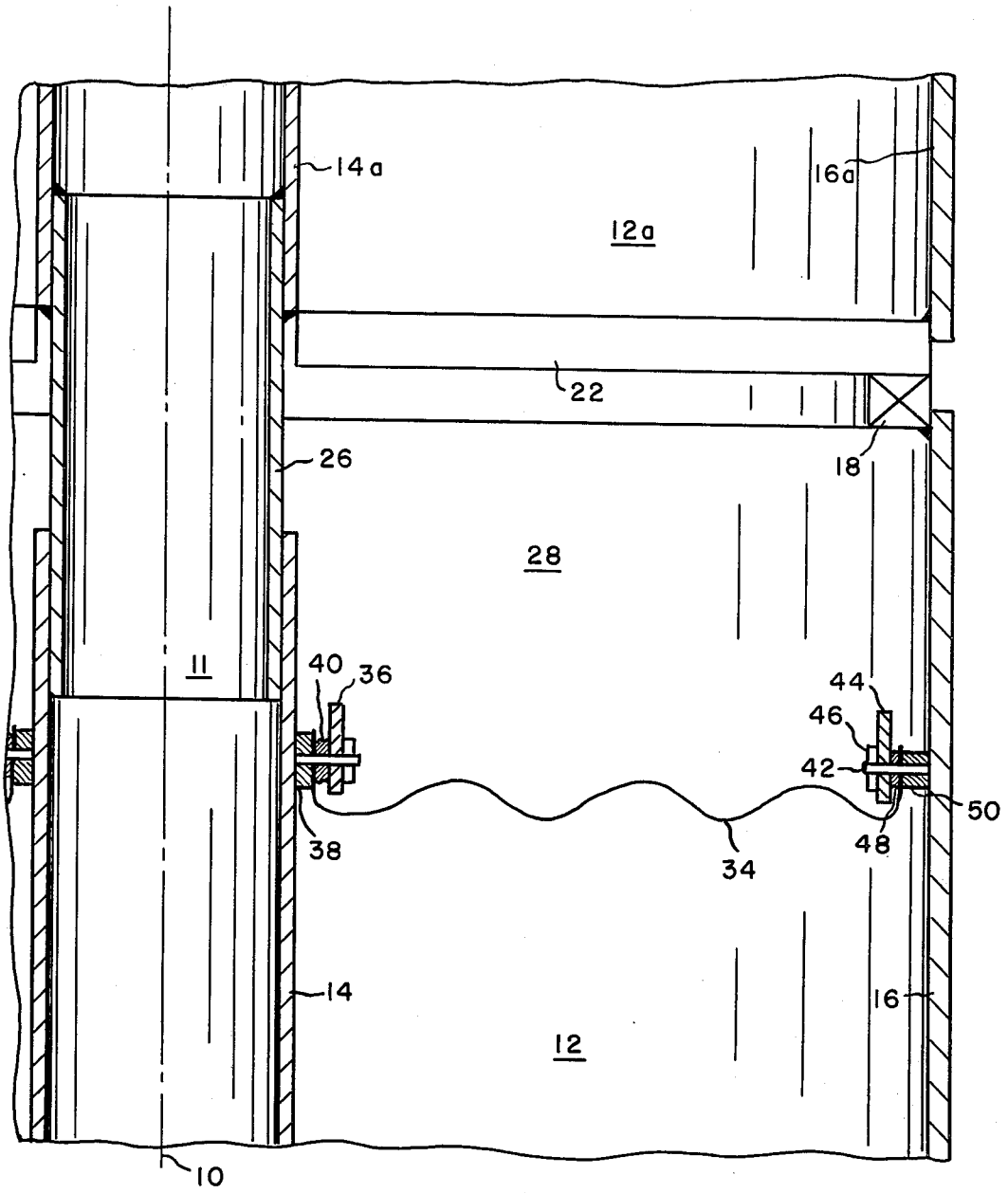

A problem with the embodiments of FIGS. 1 – 3 is that if a very large amount of expansion is required, then the top plate 20 might buckle as it is rising due to lack of space between the inner shell 14 and outer shell 16. FIG. 4 shows another embodiment which overcomes this problem where corresponding parts have been given corresponding reference numerals. Only the right hand side is shown since the invention is symmetrical about center line 10.

Instead of the top plate 20, a material such as fabric or flexible mesh 34 that loosely extends between inner shell 14 and outer shell 16 is to be used. Material 34 is shaped to conform to inner shell 14 and flue 11. Typically, this will be a circle or a rectangle. Fabric will hermetically seal the sections 12 and **12*a* from each other, if this is desired. Flexible mesh will not hermetically seal the sections, but it is cheaper. In either case, if the mesh is fine enough, the small particles will be prevented from corroding the inner wall of shell 16. At the inner shell 14, the material 34 goes under a band 36 that tightly extends about the entire outer circumference of inner shell 14 to secure the inner edge of the material 34 between it and shell 14. Two layers 38 and 40 of a high temperature acid resistant mastic can be used on either side of material 34 to provide a seal, if this is desired. At the inner wall of outer shell 16, are threaded studs 42 placed about every three inches about the inner circumference of shell 16. They are placed there by driving them towards outer shell 16 and by simultaneously applying an electric potential between them and the shell 16 so as to arc weld them on it. A clamping bar ring 44 extends around the inner wall of shell 16 and has holes in it spaced in accordance with the stud spacing so as to receive them. A nut 46 is placed over the threaded end of stud 42 so as to secure the outer edge of material 34. As before, mastic 48 and 50 can be used to provide a seal. The operation of this embodiment is similar to the other embodiments, except that because of the looseness in material 34, no buckling takes place in it as inner shell 14** rises as it is heated.

It will be appreciated that since no double flange is required, the present invention is lighter and cheaper than the prior art. It will be further appreciated that many other embodiments are possible without departing from the spirit and scope of the invention.

I claim:

1. A double walled expandable smoke stack section comprising inner and outer shells, a flange plate extending between said shells at the bottom thereof, a closure plate secured to said inner shell at the bottom thereof and extending downwardly from said flange plate, and a movable member means rigidly secured at its ends between the tops of said shells for enclosing the space between said shells and for preventing particles from entering said space.

2. A section as claimed in claim 1 wherein said member comprises a top plate prestressed downwardly towards said inner shell.

3. A section as claimed in claim 2 further comprising a splice ring disposed between said outer shell and said top plate.

4. A section as claimed in claim 3 wherein said ring has a bottom and an outer side, said top plate being secured to said bottom side of said ring, and said outer shell being secured to said outer side of said ring.

5. A section as claimed in claim 3 wherein said ring has top and outer sides and is square in cross section, said top plate being secured to said top side of said ring, and said outer shell being secured to said outer side of said ring.

6. A section as claimed in claim 3 wherein said ring has inner and outer sides said top plate being secured to the inner side, and said outer shell being secured to said outer side.

7. A section as claimed in claim 3 wherein said ring and said flange plate have beveled outer sides to receive welding material.

8. A section as claimed in claim 1 wherein said member is loose fitting.

9. A section as claimed in claim 8 wherein said member comprises fabric.

10. A section as claimed in claim 8 wherein said member comprises wire mesh.

* * * * *